US005090953A

United States Patent [19]

Büttner et al.

[11] Patent Number: 5,090,953

[45] Date of Patent: Feb. 25, 1992

[54] METHOD OF AND APPARATUS FOR WITHDRAWING LIQUID FROM A CENTRIFUGE

[75] Inventors: Otto Büttner, Puchheim; Bruno Hegnauer, Gauting, both of Fed. Rep. of Germany

[73] Assignee: Krauss-Maffei Aktiengesellschaft, Munich, Fed. Rep. of Germany

[21] Appl. No.: 619,194

[22] Filed: Nov. 27, 1990

[30] Foreign Application Priority Data

Dec. 4, 1989 [DE] Fed. Rep. of Germany ..... 3940053

[51] Int. Cl.[5] ..... B04B 11/00

[52] U.S. Cl. ..... 494/1; 494/37; 494/56

[58] Field of Search ..... 494/37, 55, 56, 57, 494/58, 59, 1, 2, 3, 4; 210/781, 97, 104, 143

[56] References Cited

U.S. PATENT DOCUMENTS 3,279,687 10/1966 Amero ..... 494/37
3,703,983 11/1972 Tholl et al. .
3,734,398 5/1973 Keith ..... 494/58
4,101,421 7/1978 Hultsch .
4,516,987 5/1985 Niggemann ..... 494/56
4,900,453 2/1990 Sedlmayer .

FOREIGN PATENT DOCUMENTS 656125 1/1938 Fed. Rep. of Germany .
2603610 8/1977 Fed. Rep. of Germany .
3726227 2/1989 Fed. Rep. of Germany .
205508 1/1940 Switzerland .
487249 6/1938 United Kingdom ..... 494/57

*Primary Examiner*—Robert W. Jenkins
*Attorney, Agent, or Firm*—Herbert Dubno; Yuri Kateshov

[57] ABSTRACT

A sensor is provided for the level of liquid or the surface characteristics of the solids and liquid layers in a centrifuge drum and controls a scoop by terminating the removal of the liquid when a surface-characteristic change representing the solids layer is reached or when the rate of change in the level within the drum approaches zero.

13 Claims, 2 Drawing Sheets

METHOD OF AND APPARATUS FOR WITHDRAWING LIQUID FROM A CENTRIFUGE

FIELD OF THE INVENTION

Our present invention relates to a method of and an apparatus for withdrawing liquid from a centrifuge of the type in which a liquid layer is formed inwardly of a solids layer upon rotation of a centrifuge drum to separate a charge consisting of a suspension of the solids in the liquid into its components. More particularly, the invention relates to a system of the type described in which the liquid is removed from the centrifuge in whole or in part by causing a liquid-paring tube to project through the free surface of the liquid layer and scoop the liquid therefrom upon rotation of the drum, that tube being referred to herein generally as a scoop.

BACKGROUND OF THE INVENTION

In the centrifuging of suspensions, especially in so-called sedimentation centrifuges, it is necessary to remove a layer of liquid which forms upon the centrifuge "cake" which consists of the solids. The removal of this liquid layer must be carried out with regularity and can be effected by dipping a liquid-paring tube or scoop into the liquid layer.

Reference may be had to German patent documents DE-OS 26 03 610, DE-PS 656 125, Swiss patent 205 508, and U.S. Pat. Nos. 3,703,983, 4,900,453, corresponding to German patent document DE-OS 37 26 227 and 4,101,421 corresponding to German patent document DE-OS 26 03 610.

In such systems in which the liquid-paring tube or scoop is moved through the surface of the layer of the liquid to draw off liquid from this layer, there is the problem of establishing that the scoop is deep enough in the contents of the centrifuge drum to draw off the liquid and, nevertheless, does not penetrate significantly into the layer of solids disposed outwardly of the layer of liquid and is withdrawn or retracted when this layer of solids is reached.

This has been achieved in the past primarily by providing a fixed abutment for the movable scoop so that at a given point in its travel it will be stopped, and if desired, swung outwardly again awaiting the next cycle of liquid removal or the next introduction of the charge into the separation centrifuge. The problem with a fixed abutment is that generally all of the liquid of the liquid layer cannot be withdrawn with such a system.

Furthermore, the residence time of a suspension in the drum is not normally constant and can vary and thus it is difficult to control the scoop by timing alone in accordance with predetermined patterns of separation. The reason for this is that conditions within the drum vary with different solids concentrations in the suspensions of different charges, with changes in the amounts of the charges upon successive operations, with viscosity changes of the liquid and with shifts of the filter elements which may be used.

Because of these different effects which cannot be predicted in many cases and cannot therefore be taken into consideration, the operation of the scoop based upon timing considerations is difficult or impractical.

OBJECTS OF THE INVENTION

It is, therefore, the principal object of the present invention to provide an improved method of withdrawing liquid from the liquid layer of a centrifuge whereby the above-described drawbacks are obviated.

Another object of the invention is to provide an improved apparatus for the withdrawal of liquid from a centrifuge drum so that precise control may be obtained of the scooping operation.

SUMMARY OF THE INVENTION

These objects and others which will become apparent hereinafter are attained, in accordance with the present invention in a method of operating a centrifuge in which a liquid scooping tube is depressed to dip into the liquid layer in the centrifuge and in which a sensor is provided to monitor the level of the contents of the centrifuge and/or the surface characteristics of the contents of the centrifuge and the liquid extraction operation is terminated when the time rate of change of the level approaches zero and/or when the sensor detects the transition of the surface characteristics from solid to liquid.

In the apparatus aspect of the invention, therefore, the means for carrying out these steps are provided.

The method of the invention, more specifically, can comprise the steps of:

(a) advancing a liquid-extraction scoop into the layer of liquid during rotation of the drum to progressively remove liquid from the layer of liquid;

(b) automatically monitoring with at least one sensor during rotation of the drum at least one parameter of the contents of the drum and including:

($b_1$) a level of the contents of the drum, and ($b_2$) a characteristic of an exposed surface of the contents of the drum; and (c) terminating the advancing of the liquid-extraction scoop into the layer of liquid in response to the automatic monitoring of step (b), thereby terminating removal of the liquid from the drum, selectively upon ($c_1$) a change of the level with time approaching zero, and ($c_2$) the sensor detecting a transition of the characteristic from liquid to solid.

The apparatus can, therefore, comprise:

a liquid extraction scoop positioned to contact the layer of liquid ;

means for advancing the liquid-extraction scoop into the layer of liquid during rotation of the drum to progressively remove liquid from the layer of liquid;

at least one sensor for automatically monitoring at least one parameter of the contents of the drum and including:

a level of the contents of the drum, and a characteristic of an exposed surface of the contents of the drum; and means for terminating the advancing of the liquid-extraction scoop into the layer of liquid in response to the automatic monitoring by the sensor, thereby terminating removal of the liquid from the drum, selectively upon a change of the level with time approaching zero, and the sensor detecting a transition of the characteristic from liquid to solid.

Since the scooping process is controlled by the level of the contents in the centrifuge drum and/or the surface characteristics of the contents directly by a monitoring sensor, the removal of the liquid can be terminated when all of the liquid of the layer is withdrawn with a high degree of precision. The duration of the withdrawal operation can be optimized and even in the case in which the scoop is disposed within the body of the drum proper, it is possible to withdraw the liquid precisely to the surface of the solids collected therein.

According to a feature of the invention, therefore, the scoop can be disposed either within the body of the drum or in a pocket adjacent the body of the drum and connected to the latter with lateral openings which may be covered with a filter medium or screen preventing passage of solids into the aforementioned pocket.

According to a feature of the invention, the liquid extraction scoop is moved continuously into the layer of liquid at a constant speed or with a constant force and, following termination of the scoop operation, the scoop is returned to a starting position, e.g. out of a liquid layer.

According to an apparatus aspect of the invention, the scoop can be provided with an external drive for displacing into the liquid layer and/or can be formed with formations or elements engaging the liquid and hydrodynamically countering the force displacing the scoop into the liquid layer. The scoop can have a skid on a side thereof facing the solids layer so that, when liquid removal is complete, the scoop can ride on the solids layer.

Advantageously the scoop is mounted for angular displacement within the drum and is provided with a signal generator outputting a signal representing angular displacement of the scoop. The sensor can be mounted within the drum or provided directly on the scoop.

BRIEF DESCRIPTION OF THE DRAWINGS

The above and other objects, features and advantages of the present invention will become more readily apparent from the following description, reference being made to the accompanying drawing in which.

SPECIFIC DESCRIPTION

Figure 1:
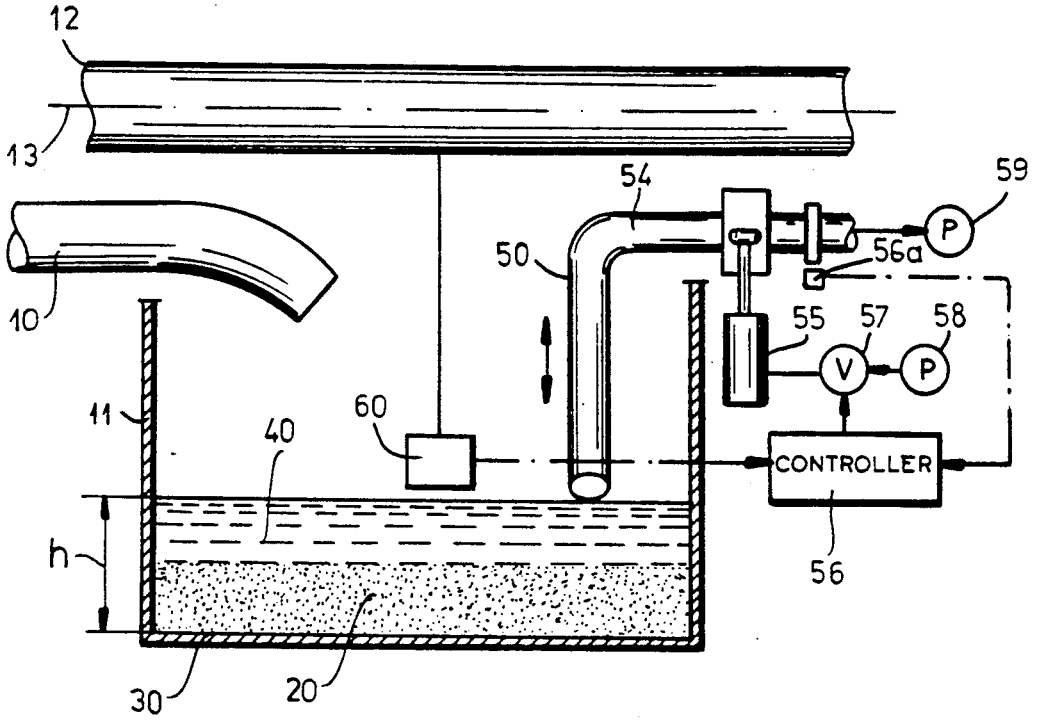
FIG. 1 is a schematic illustration of one embodiment of a sedimentation centrifuge provided with a liquid-paring scoop for removing liquid according to the invention.

FIG. 1 illustrates, in highly diagrammatic form, a sedimentation centrifuge in which a filling pipe 10 introduces a charge in the form of a suspension into the interior of a drum 11 carried by a centrifuge shaft 12 driven at high speed about the axis 13 of that drum by a motor (not shown).

By centrifugation within this drum, the charge is separated into a solids component 20 which lies as a solids layer along the wall 30 of the drum and a liquid layer 40 which lies inwardly of the solids layer 20.

The drum has been shown in highly diagrammatic form as being attached to the shaft 12. In practice, it will be understood that various attachment techniques are used for mounting the drum on a shaft to allow the pipe 10 to project into the drum and to enable the scoop 50 to extend from the interior of the drum. Any of these mounting expedients may be used in the embodiment described herein.

The liquid scooping tube 50 can be seen to be located within the body of the drum and to have a mouth 51 which is designed to fill liquid from the drum as the drum rotates in the direction of the arrow 52. The height of the liquid in the drum is represented at h. The tube or scoop 50 is mounted for pivotal movement (see the arrow 53) about the pipe section 54 which can be connected to a drive 55, here shown as a hydraulic cylinder to apply constant force or constant speed of the scoop into the liquid layer 40, and to return the scoop to a starting position out of the liquid in response to a controller 56. The controller 56 is shown to control the cylinder 55 through a valve 57 connected to a pressure medium source 58.

A pump 59 is connected to the scoop to carry away the liquid and a sensor **56*a*** is provided to detect the angular position of the scoop.

In the embodiment illustrated in FIG. IA, the scoop 50 is provided in a pocket 70 adjacent the drum proper and connected to the latter by holes or ports 71 which may be covered by a screen or filter medium excluding solids from the annular compartment constituting the pocket 70. The use of such pocket is described and illustrated in, for example, U.S. Pat. No. 4,101,421, and a control 56', for example, is provided for the displacement of the scoop and can receive an input from a sensor **56*a'* outputting a signal representing the angular displacement of the scoop. The scoop is connected to a pump 59'** as has been described.

Figure 2:
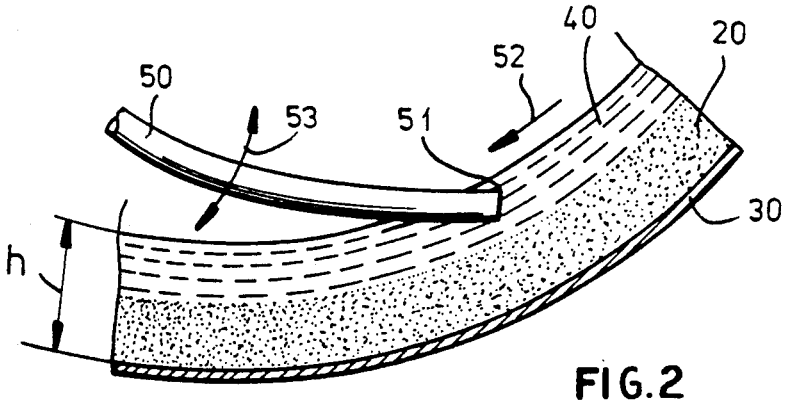
FIG. 2 is a detail view in cross section through the drum showing the position of the tube.
Figure 1A:
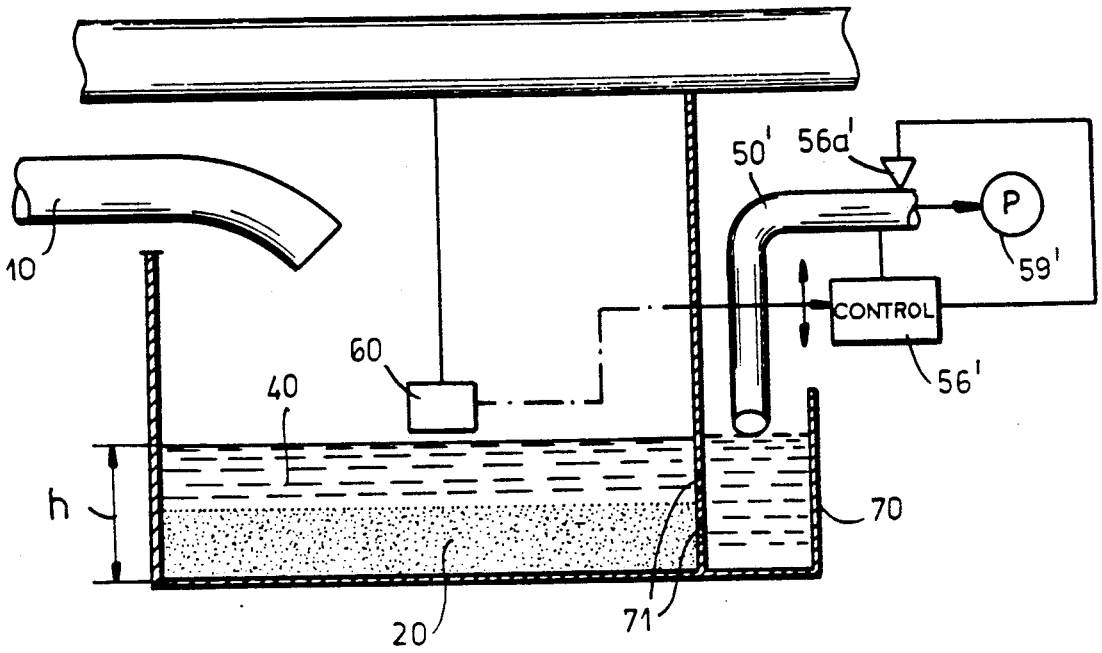
FIG. 1A is a similar view of another embodiment.

In the embodiments of both FIG. 1 and FIG. 1A, during the separation process and for withdrawal of the liquid 40, the surface of the contents of the drum are monitored by a sensor 60 which can detect the height h of the contents (FIG. 2) and/or the surface characteristics of the interface between the liquid and solids layers. A sensor of this type is described, for example, in German patent document DE-OS 37 26 227 (see U.S. Pat. No. 4,900,453).

For removal of the liquid 40, the liquid scooper 50 or 50' following segregation of the solids and liquid into the two layers, is swung into the liquid layer 40. The invention ensures that the liquid scoop 50 will be swung sufficiently into the layer to extract the liquid but will not be forced into the solids layer so that solids are drawn off or disturbed.

According to the invention, the scoop 50 or 50' during the liquid removal operation is displaced into the liquid and toward the solids surface with a constant speed or with a constant force while the sensor 60 monitors the height h and/or the surface characteristics. When the height h shows no further change with time or when a change in the surface characteristics indicative of reaching the solids layer is signalled, the scoop operation is interrupted and the scoop 50 or 50' is retracted.

Figure 3:
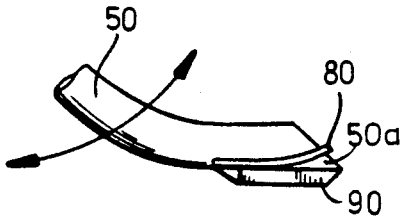
FIG. 3 is a side elevational view of an end of the scoop.
Figure 4:
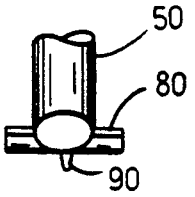
FIG. 4 is an end view thereof.

FIGS. 3 and 4 show a device which can be used to provide the force for displacing the tube into the liquid layer. At the end **50*a* of the tube 50, a drive surface 80 is provided which is in the form of hydrodynamic plane biased by the rotating liquid layer radially inwardly and generating a force opposite the force which tends to displace the scoop into the liquid layer. As described, the tube 50 is provided with a constant force or a constant torque outwardly, for example, by the hydraulic device 55 described or a spring arrangement. The form of the surfaces 80** is such that the force which it generates on the scoop is determined by the speed of the drum so that the hydrodynamic force and the constant force operate opposite one another and hold the scoop into the liquid.

The end of the tube 50 turned toward the solids layer 20 is provided with a skid 90 which reduces impact by the scoop 50 on the liquid layer or the solids layer.

Figure 5:
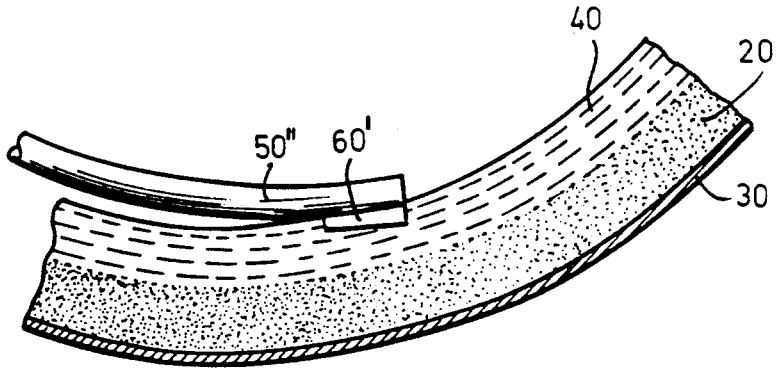
FIG. 5 is a view similar to FIG. 2 but illustrating an embodiment in which the scoop is provided with the sensor.

When the device of FIGS. 3 and 4 is provided within the drum, it may be possible to use only the angle-detecting sensor 56*a* or 56*a'* providing an output of the angular position of the scoop from which angular position the change in liquid level can be detected. It is, of course, also possible to provide the scoop 50" with a sensor 60' directly, as has been shown in FIG. 5, by way of example.

As a general matter, the apparatus can be equipped with a sensor for detecting the surface characteristics of the layers so that the removal of liquid to the solids layer can be accurately determined and the scoop retracted.

Since the system actually monitors the liquid level and the surface characteristics, it is not dependent upon time which will not allow accurate liquid extraction as has been described. The scoop cannot penetrate into the solids if provided with the skid and the hydrodynamic plane 90 and 80, respectively, so that little or no solids are removed in the liquid extraction process.

We claim:

1. A method of withdrawing liquid from a centrifuge in which a layer of said liquid is formed on a layer of solids on a centrifuge drum upon rotation thereof in order to separate said solids from said liquid, constituting contents of said drum, in a suspension charged into said drum, said method comprising the steps of:

(a) advancing a liquid-extraction scoop into said layer of liquid during rotation of said drum to progressively remove liquid from said layer of liquid said contents of said drum having as parameters of level of the contents of said drum, and a characteristic of an exposed surface of the contents of said drum, (b) automatically monitoring with at least one sensor during rotation of said drum at least one of said parameters of the contents of said drum and including:

($b_1$) a level of the contents of said drum, and ($b_2$) a characteristic of an exposed surface of the contents of said drum; and (c) terminating said advancing of said liquid-extraction scoop into said layer of liquid in response to the automatic monitoring of step (b), thereby terminating removal of said liquid from said drum, selectively upon ($c_1$) a rate of charge of said level approaching zero, and ($c_2$) said sensor detecting a transition of said characteristic from liquid to solid.

2. The method defined in claim 1 wherein said scoop removes said liquid directly from an interior of said drum in which said liquid covers said solids.

3. The method defined in claim 1 wherein said liquid from said layer of liquid passes into an annular pocket rotating with said drum and communicating by openings with an interior of said drum, said scoop removing said liquid from said pocket.

4. The method defined in claim 1 wherein said liquid-extraction scoop is moved continuously into said layer of liquid during rotation of said drum to remove said liquid from said

5. The method defined in claim 4 wherein said liquid-extraction scoop is moved continuously into said layer of liquid at a constant speed during rotation of said drum to remove said liquid from said drum.

6. The method defined in claim 4 wherein said liquid-extraction scoop is moved continuously into said layer of liquid with a constant force during rotation of said drum to remove said liquid from said drum.

7. The method defined in claim 1, further comprising the step of:

(d) returning said scoop to a starting position after terminating the advance of said liquid-extraction scoop into said liquid and removal of liquid from said drum.

8. An apparatus for withdrawing liquid from a centrifuge in which a layer of said liquid is formed on a layer of solids on a centrifuge drum upon rotation thereof in order to separate said solids from said liquid, constituting contents of said drum, in a suspension charged into said drum, said apparatus comprising:

a liquid extraction scoop positioned to contact said layer of liquid ;

means for advancing said liquid-extraction scoop into said layer of liquid during rotation of said drum to progressively remove liquid from said layer of liquid, said contents of said drum having as parameters a level of the contents of said drum, and a characteristic of an exposed surface of the contents of said drum, at least one sensor for automatically monitoring at least one of said parameters of the contents of said drum; and means for terminating said advancing of said liquid-extraction scoop into said layer of liquid in response to the automatic monitoring by said sensor, thereby terminating removal of said liquid from said drum, selectively upon a rate of change of said level approaching zero, and said sensor detecting a transition of said characteristic from liquid to solid.

9. The apparatus defined in claim 8 wherein said scoop is a liquid-paring tube positioned to shear liquid from said liquid layer and provided with drive elements applying a force to said tube countering a tendency to drive said tube into said liquid layer upon engagement of said tube with said liquid layer.

10. The apparatus defined in claim 9 wherein said tube is provided with a skid on a side thereof facing said layer of

11. The apparatus defined in claim 8 wherein said scoop is mounted for angular displacement within said drum and is provided with a signal generator outputting a signal representing angular displacement of said scoop.

12. The apparatus defined in claim 8 wherein said sensor is provided on said scoop.

13. The apparatus defined in claim 8 wherein said means for advancing said liquid-extraction scoop into said layer of liquid during rotation of said drum to progressively remove liquid from said layer of liquid includes a drive continuously applying a drive force to said scoop and operatively connected thereto.

* * * * *